US012275574B1

(12) United States Patent
Pack

(10) Patent No.: US 12,275,574 B1
(45) Date of Patent: Apr. 15, 2025

(54) ANCHORED BEVERAGE CONTAINER ASSEMBLY

(71) Applicant: Bryan Pack, Scottsdale, AZ (US)

(72) Inventor: Bryan Pack, Scottsdale, AZ (US)

( * ) Notice: Subject to any disclaimer, the term of this patent is extended or adjusted under 35 U.S.C. 154(b) by 39 days.

(21) Appl. No.: 18/382,494

(22) Filed: Oct. 21, 2023

(51) Int. Cl.
*A47G 23/02* (2006.01)
*A47G 29/093* (2006.01)
*B65D 25/10* (2006.01)
*B65D 81/38* (2006.01)

(52) U.S. Cl.
CPC ..... *B65D 81/3876* (2013.01); *A47G 23/0216* (2013.01); *A47G 29/093* (2013.01); *B65D 25/10* (2013.01)

(58) Field of Classification Search
CPC ..... A47G 23/0225; A47G 23/0216; A47G 19/06; A47G 19/2261; A47G 19/2205; F16M 13/022; F16B 47/00; B60N 3/103
USPC ..... 248/314, 311.2; 206/217; 224/926; 220/737
See application file for complete search history.

(56) References Cited

U.S. PATENT DOCUMENTS 5,071,002 A 12/1991 Bradley
6,000,575 A 12/1999 LaCour
6,059,138 A * 5/2000 Labruyere ..... A47G 23/0225 220/574
6,571,976 B1 * 6/2003 Sonnabend ..... B65D 25/24 220/737
8,840,078 B2 9/2014 DeWald
D751,347 S 3/2016 DeWald
D873,624 S 1/2020 Rogers
2015/0342382 A1 * 12/2015 D'Alesio ..... A47G 23/0216 220/737
2018/0199742 A1 7/2018 Rogers
2020/0383527 A1 12/2020 Mosseri
2022/0205586 A1 * 6/2022 Zimmerman ..... F16B 47/00

FOREIGN PATENT DOCUMENTS

WO WO9951131 10/1999

* cited by examiner

*Primary Examiner* — King M Chu

(57) ABSTRACT

An anchored beverage container assembly includes a canister that has a top end which is open to insertably receive a beverage container. A stem slot extends through the canister to accommodate a stem of a wine glass and the canister has a base slot extending through the canister to accommodate a base of the wine glass. The canister has a locking slot extending into the canister. A first anchor is insertable into the locking slot and a spike extends downwardly from the first anchor to penetrate a support surface for securing the canister to the support surface. A second anchor is insertable into the locking slot and a suction sup extends downwardly from the second anchor for securing the canister to a support surface. A third anchor is insertable into the locking slot and a buoyant float extends downwardly from the third anchor to float in a body of water.

9 Claims, 10 Drawing Sheets

ANCHORED BEVERAGE CONTAINER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to beverage container devices and more particularly pertains to a new beverage container device for securing a beverage container to a variety of surfaces. The device includes a canister which can insertably receive a beverage container and the canister has a stem slot and a base slot to accommodate a stem and a base of a wine glass to facilitate the wine glass to be slid laterally into or out of the canister. The device includes a plurality of anchors that are each affixable to the canister and which each has a unique supporting element for either penetrating the ground or suctionally engaging a support surface or floating in a body of water.

(2) Description of Related Art Including Information Disclosed Under 37 CFR 1.97 and 1.98

The prior art relates to beverage container devices including a variety of buoyant beverage containers for floating a beverage container and a variety of beverage holders that have slots for accommodating a stem and a base of a wine glass and a beverage holder that has a slot to accommodate a handle of a coffee mug. In no instance does the prior art disclose a beverage holder that includes a canister which has slots to accommodate a stem and a base of a wine glass and a plurality anchors that are each affixable to the canister for supporting the canister on a variety of support surfaces or to float the canister.

BRIEF SUMMARY OF THE INVENTION

An embodiment of the disclosure meets the needs presented above by generally comprising a canister that has a top end which is open to insertably receive a beverage container. A stem slot extends through the canister to accommodate a stem of a wine glass and the canister has a base slot extending through the canister to accommodate a base of the wine glass. The canister has a locking slot extending into the canister. A first anchor is insertable into the locking slot and a spike extends downwardly from the first anchor to penetrate a support surface for securing the canister to the support surface. A second anchor is insertable into the locking slot and a suction sup extends downwardly from the second anchor for securing the canister to a support surface. A third anchor is insertable into the locking slot and a buoyant float extends downwardly from the third anchor to float in a body of water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
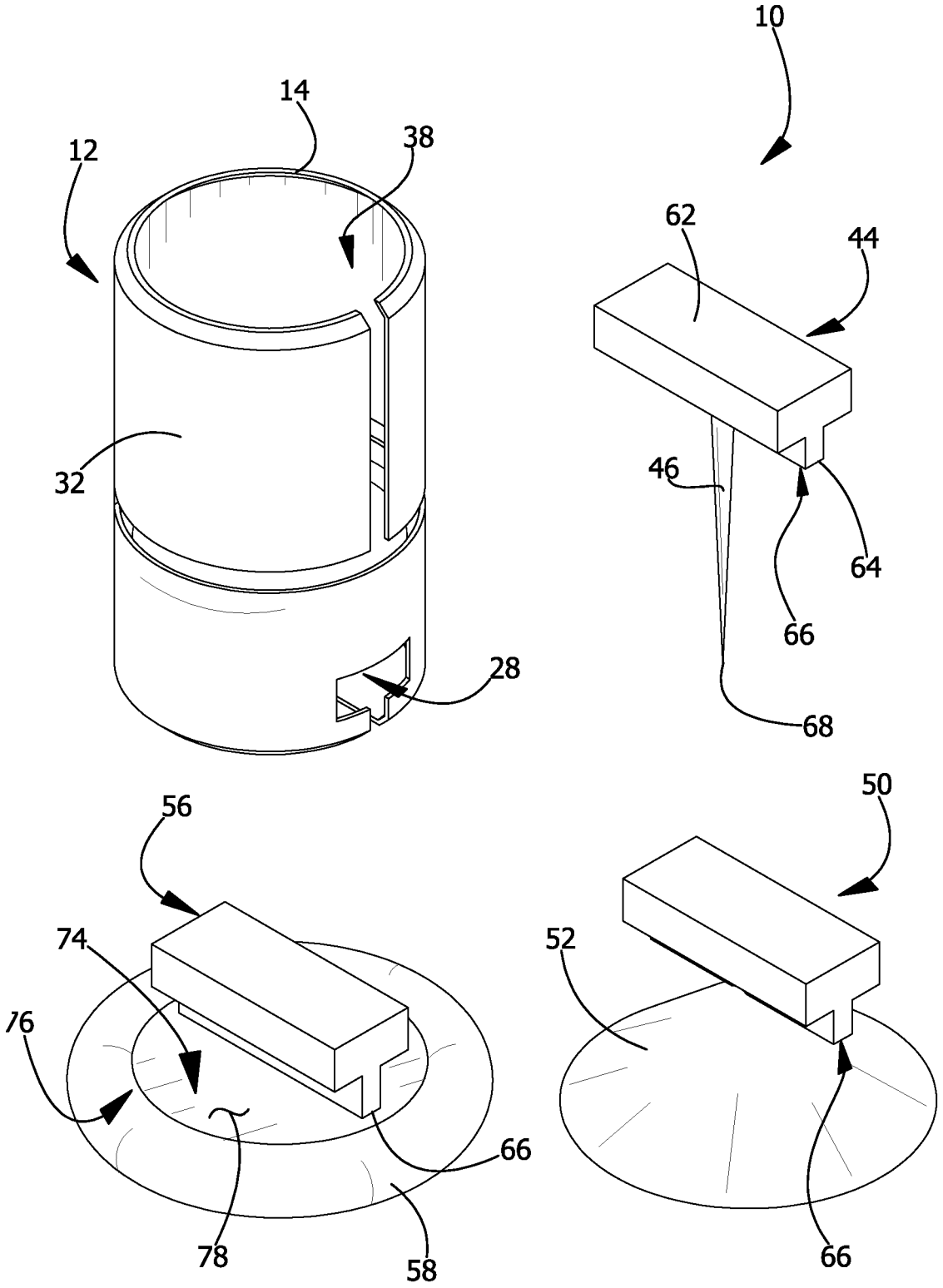
FIG. 1 is a perspective view of an anchored beverage container assembly according to an embodiment of the disclosure.
Figure 2:
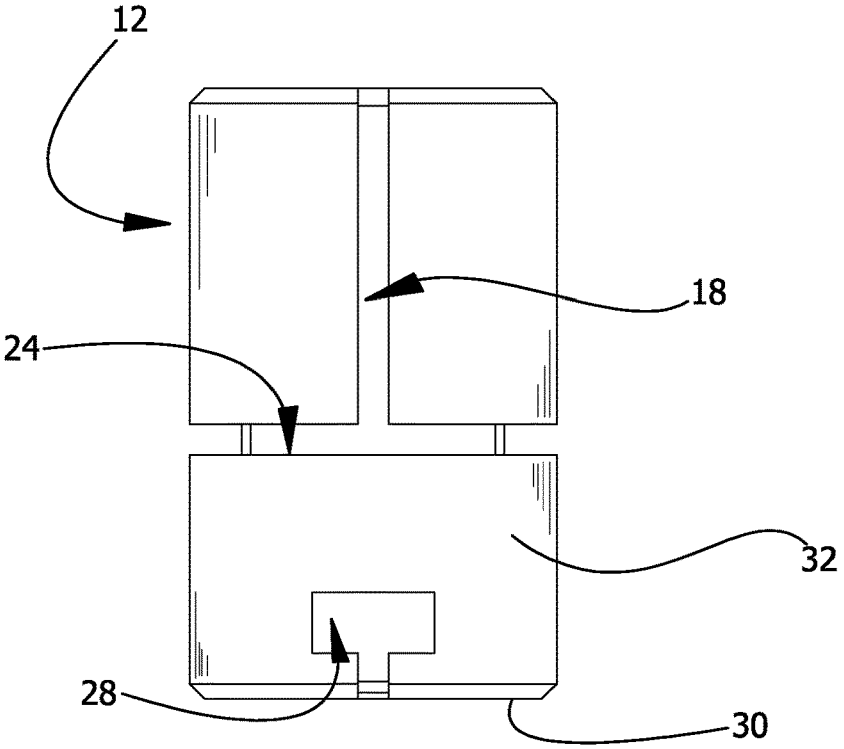
FIG. 2 is a front view of a canister an embodiment of the disclosure.
Figure 3:
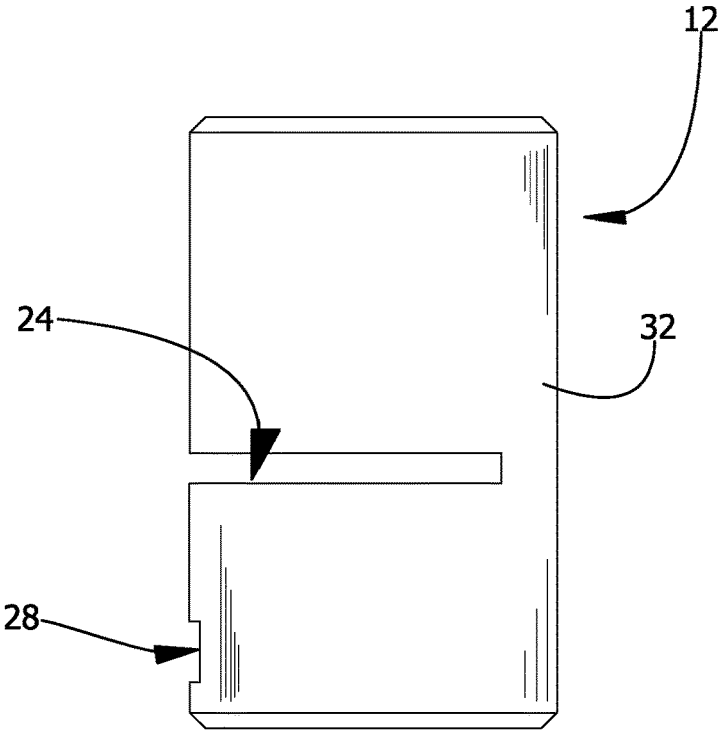
FIG. 3 is a left side view of a canister an embodiment of the disclosure.
Figure 4:
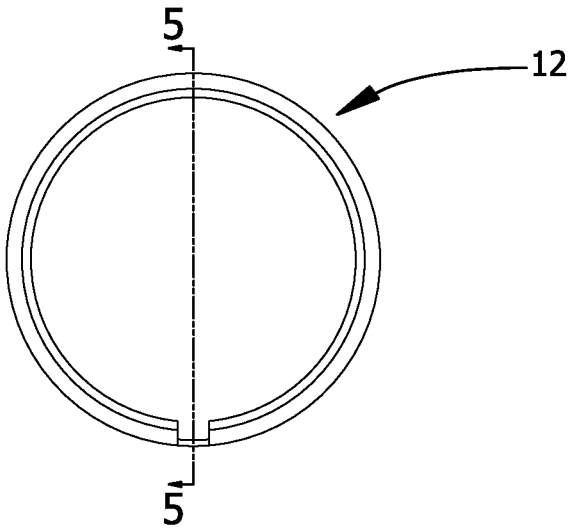
FIG. 4 is a top view of a canister of an embodiment of the disclosure.
Figure 5:
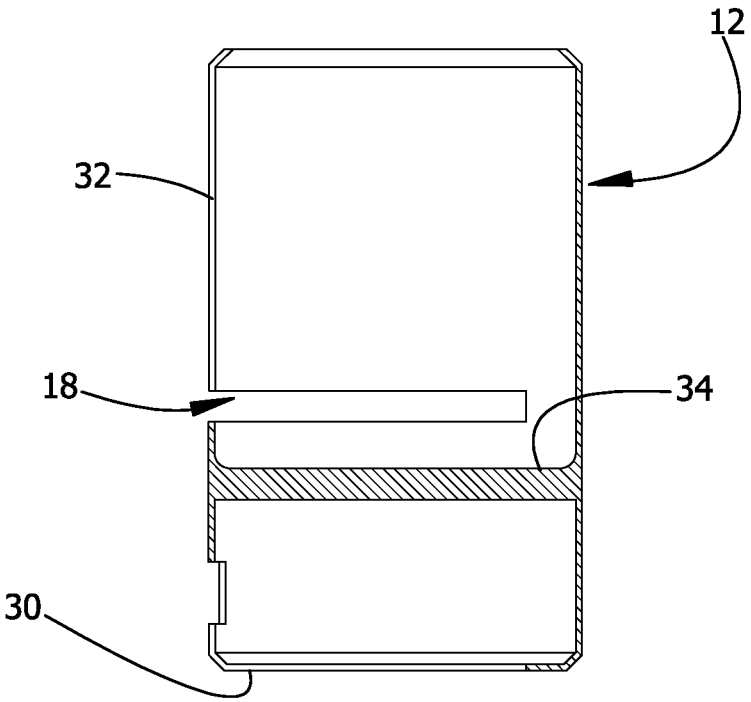
FIG. 5 is a cross sectional view taken along line 5-5 of FIG. 4 of an embodiment of the disclosure.
Figure 6:
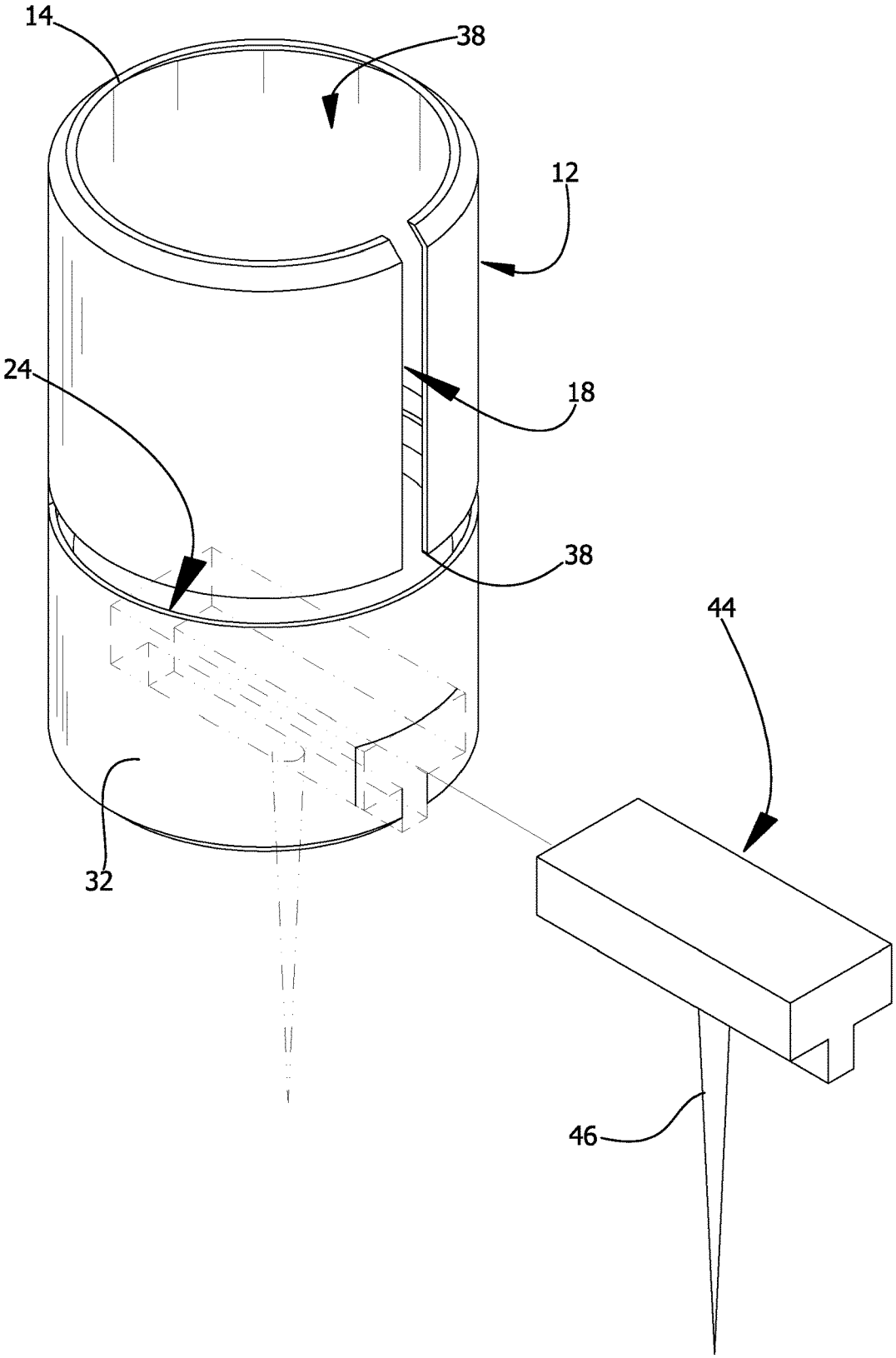
FIG. 6 is an exploded perspective view of an embodiment of the disclosure.
Figure 7:
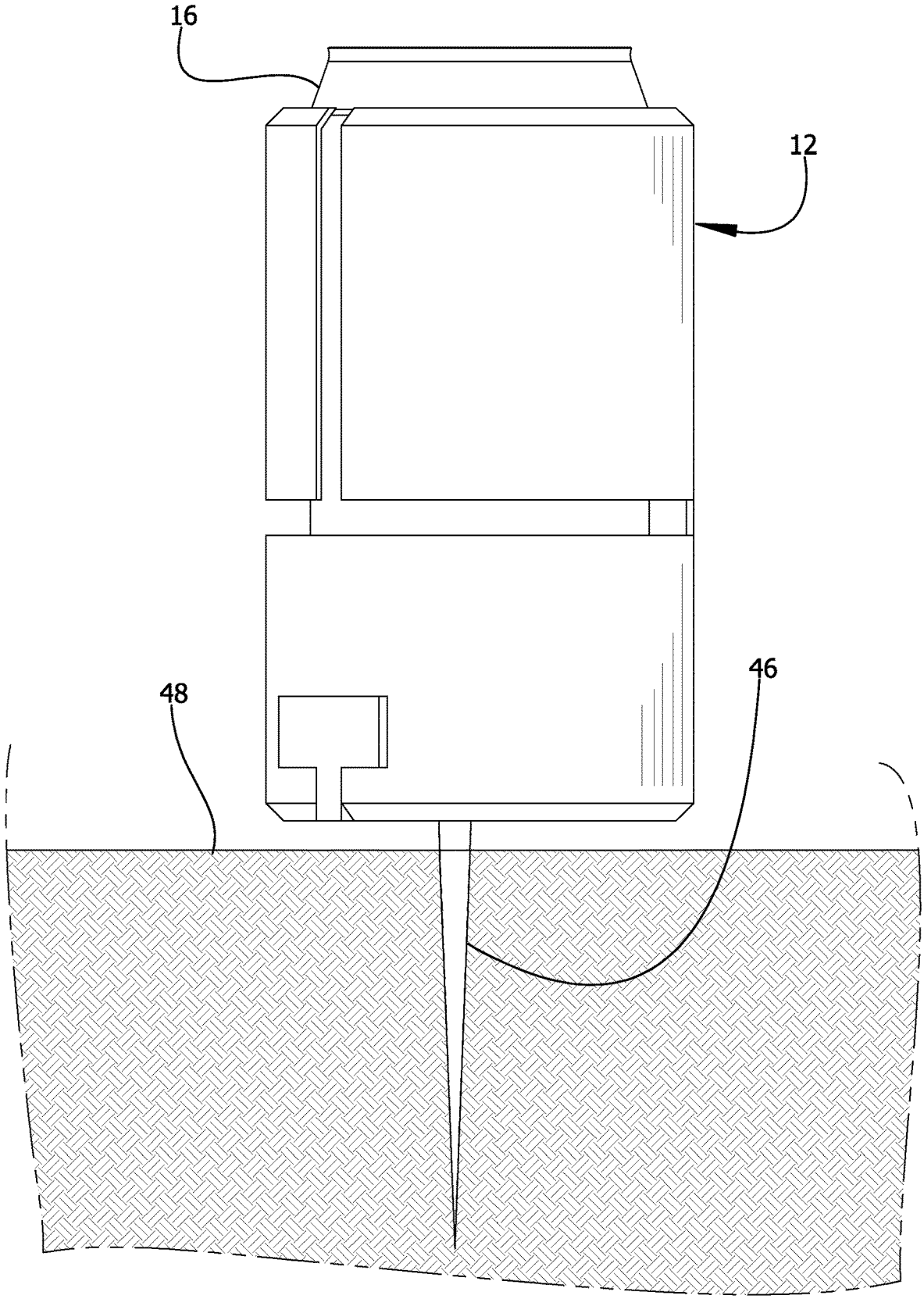
FIG. 7 is a perspective in-use view of an embodiment of the disclosure showing a first anchor being attached to a canister.
Figure 8:
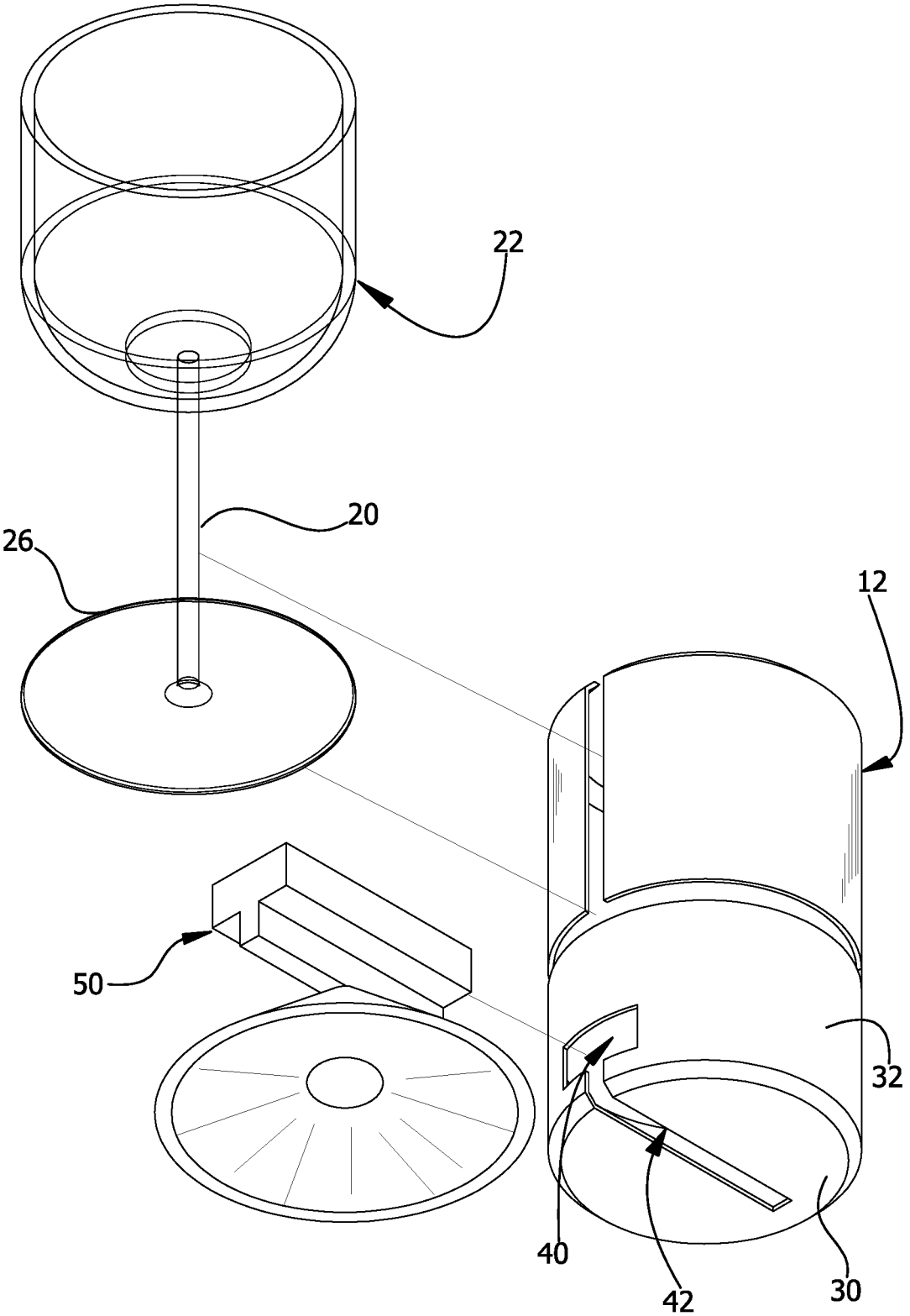
FIG. 8 is an exploded perspective view of an embodiment of the disclosure showing a second anchor being affixed to a canister.
Figure 9:
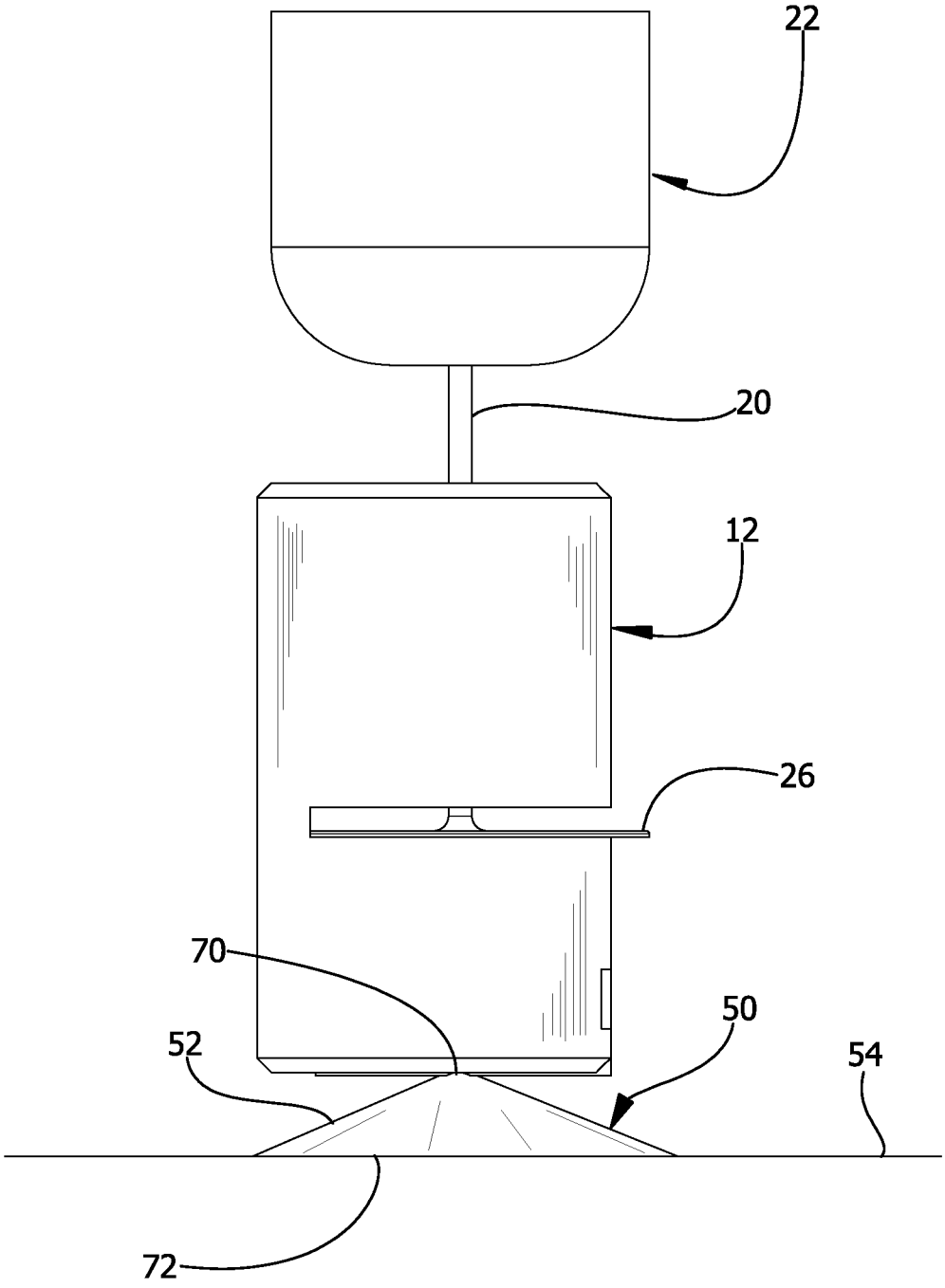
FIG. 9 is a perspective in-use view of an embodiment of the disclosure showing a second anchor being affixed.
Figure 10:
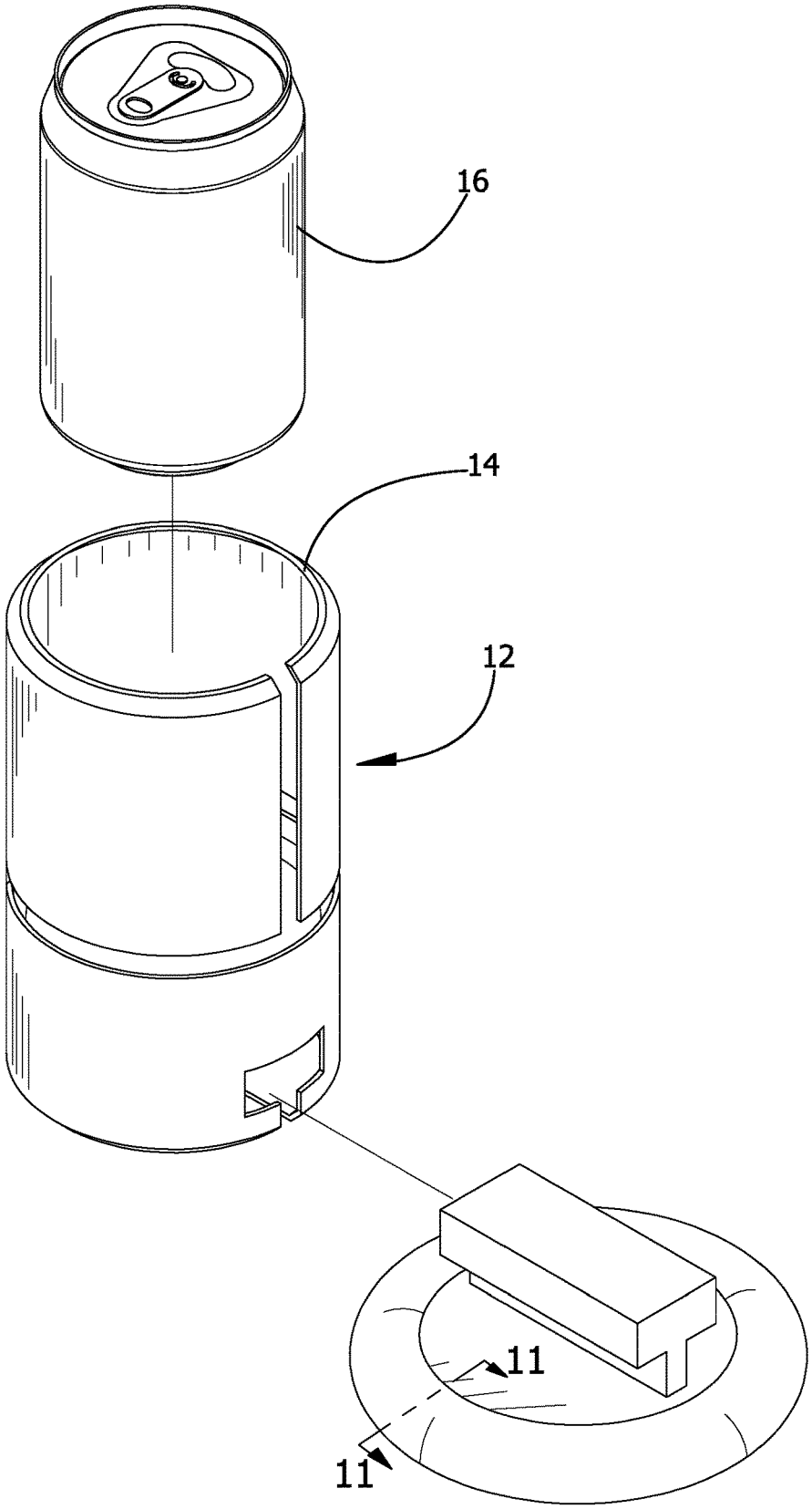
FIG. 10 is an exploded perspective view of an embodiment of the disclosure showing a third anchor being affixed to a canister.
Figure 11:
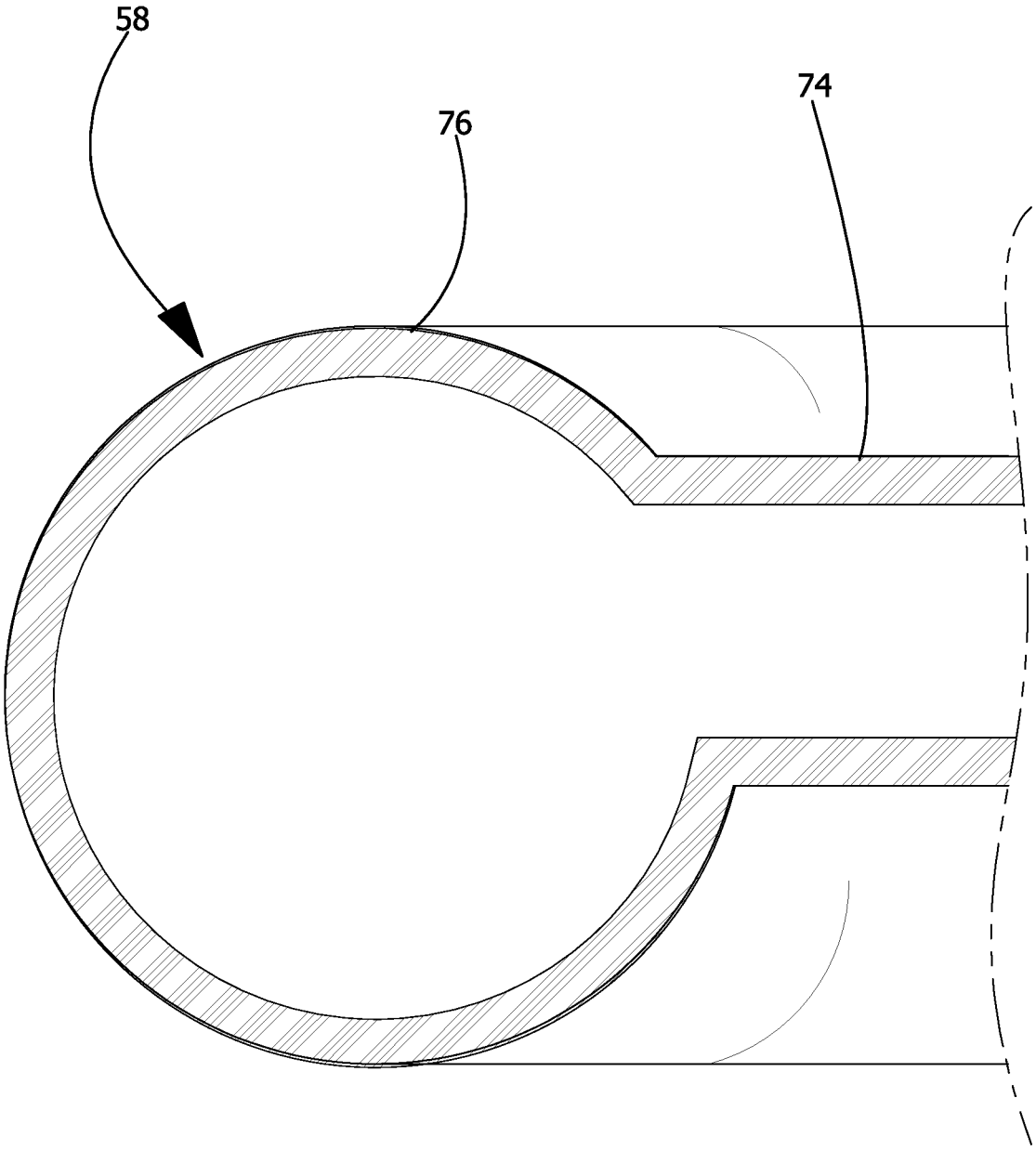
FIG. 11 is a cross sectional view taking along line 11-11 of FIG. 10 of an embodiment of the disclosure.
Figure 12:
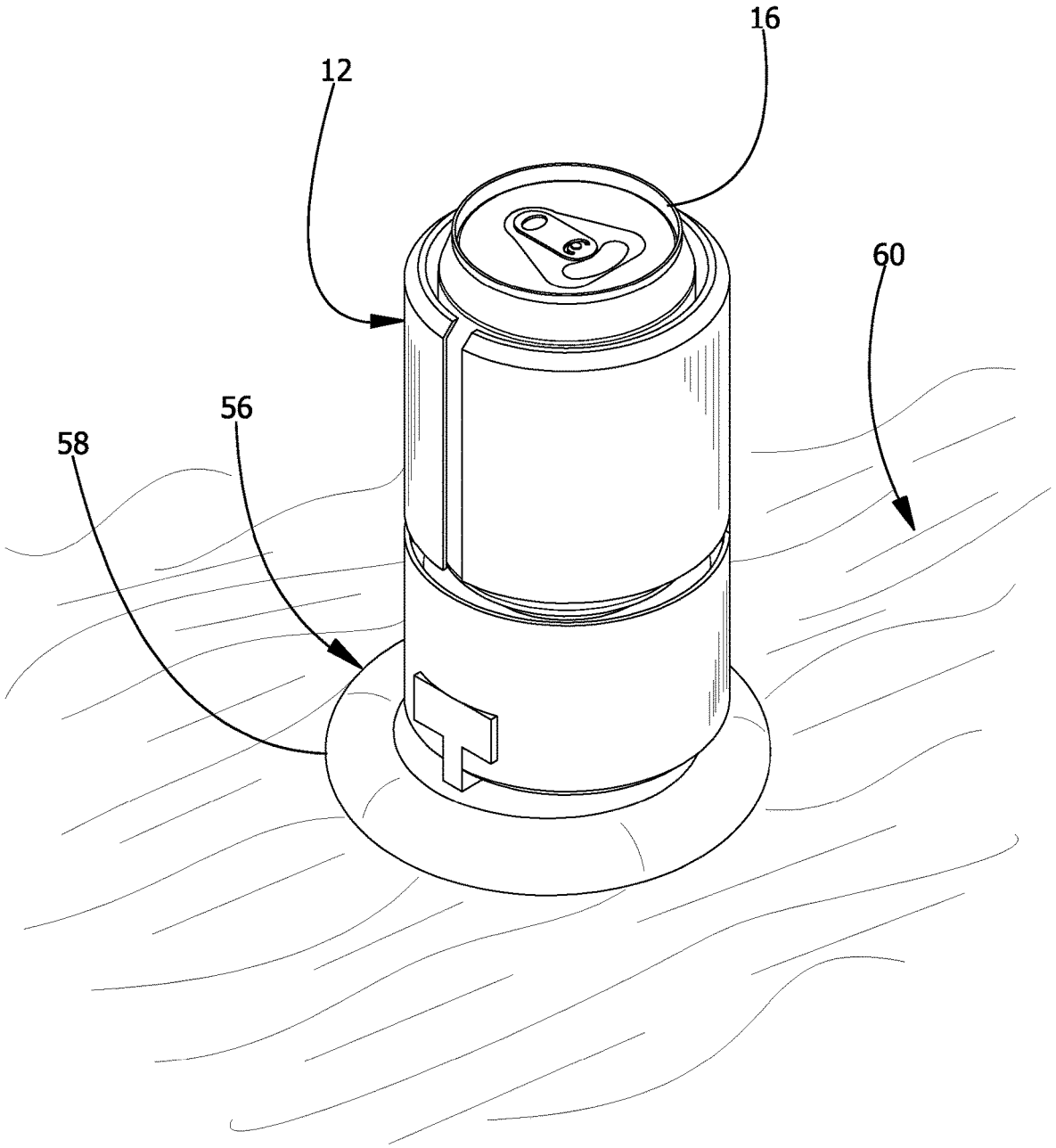
FIG. 12 is a perspective in-use view of an embodiment of the disclosure showing a third anchor floating in a body of water.

With reference now to the drawings, and in particular to FIGS. 1 through 12 thereof, a new beverage container device embodying the principles and concepts of an embodiment of the disclosure and generally designated by the reference numeral 10 will be described.

As best illustrated in FIGS. 1 through 12, the anchored beverage container assembly 10 generally comprises a canister 12 that has a top end 14 which is open to insertably receive a beverage container 16. The canister 12 is comprised of a thermally insulating material to inhibit thermal communication between the beverage container 16 and ambient air when the beverage container 16 is positioned in the canister 12. The canister 12 has a stem slot 18 extending through the canister 12 to accommodate a stem 20 of a wine glass 22 to facilitate the wine glass 22 to be slid laterally into the canister 12. Additionally, the canister 12 has a base slot 24 extending through the canister 12 to accommodate a base 26 of the wine glass 22 when the wine glass 22 is slid laterally into the canister 12.

The canister 12 has a locking slot 28 extending into the canister 12 and the canister 12 has a bottom wall 30 and an outer wall 32 extending upwardly from the bottom wall 30. The canister 12 has a partition 34 that is positioned closer to the bottom wall 30 than the top end 14 of the canister 12 . . . . Additionally, the partition 34 lies on a plane that is oriented parallel to the bottom wall 30 such that the beverage container 16 or the base 26 of the wine glass 22 rests on the partition 34. The outer wall 32 curls inwardly adjacent to the top end 14 such that an opening 38 defined by the top end 14 has a lesser diameter than a diameter of the outer wall 32.

The stem slot 18 extends through the outer wall 32 and the stem slot 18 extends from the top end 14 of the outer wall 32 toward the partition 34. The base slot 24 extends through the outer wall 32 and the base slot 24 intersects a bottom end 38 of the stem slot 18 having the base slot 24 being perpendicularly oriented with the stem slot 18 such that the stem slot 18 and the base slot 24 form a T shape. The base slot 24 is positioned closer to the partition 34 of the canister 12 and the top end 14 of the outer wall 32 of the canister 12. The locking slot 28 has a first section 40 extending through the outer wall 32 of the canister 12. The first section 40 is positioned closer to the bottom wall 30 than the partition 34 and the first section 40 is oriented parallel to the bottom wall 30. The locking slot 28 has a second section 42 extending through the outer wall 32 of the canister 12 and the bottom wall 30 of the canister 12. The second section 42 extends downwardly from and is perpendicularly oriented with the first section 40 and the second section 42 extends substantially across the bottom wall 30 of the canister 12.

A first anchor 44 is insertable into the locking slot 28 in the canister 12 thereby affixing the canister 12 to the first anchor 44. The first anchor 44 has a spike 46 extending downwardly from the first anchor 44 to penetrate a support surface 48 for securing the canister 12 to the support surface 48. In this way the beverage container 16 or wine glass 22 is inhibited from tipping when the beverage container 16 or the wine glass 22 is in the canister 12.

A second anchor 50 is insertable into the locking slot 28 in the canister 12 thereby affixing the canister 12 to the second anchor 50. The second anchor 50 has a suction cup 52 extending downwardly from the second anchor 50 which can be compressed against a support surface 54 to suctionally engage the support surface 54. In this way the canister 12 is secured to the support surface 54 thereby inhibiting the beverage container 16 or the wine glass 22 from tipping when the beverage container 16 or the wine glass 22 is in the canister 12. The support surface 54 upon which the suction cup 52 is compressed may be a tabletop, for example, or other type of rigid support surface.

A third anchor 56 is insertable into the locking slot 28 in the canister 12 thereby affixing the canister 12 to the third anchor 56. The third anchor 56 has a buoyant float 58 extending downwardly from the third anchor 56. In this way the buoyant float 58 can float in a body of water 60 thereby floating the canister 12 in the body of water 60. In this way the beverage container 16 or the wine glass 22 is inhibited from tipping when the beverage container 16 or the wine glass 22 is in the canister 12. The body of water 60 may be a swimming pool, for example, or other body of water commonly associated with recreational activities.

Each of the first anchor 44, the second anchor 50 and the third anchor 56 has a top member 62 and a bottom member 64 extending downwardly from and being perpendicularly oriented with the top member 62 such that each of the first anchor 44 and the second anchor 50 and the third anchor 56 has a T shape. The top member 62 of a respective one of the first anchor 44 or the second anchor 50 or the third anchor 56 is insertable into the first section 40 of the locking slot 28. Additionally, the bottom member 64 of a respective one of the first anchor 44 or the second anchor 50 or the third anchor 56 is insertable into the second section 42 of the locking slot 28.

The spike 46 is coupled to and extends downwardly from a lower surface 66 of the bottom member 64 of the first anchor 44. The spike 46 tapers to a point at a distal end 68 of the spike 46 with respect to the lower surface 66 and the spike 46 is centrally located along the bottom member 64 of the first anchor 44. The suction cup 52 has a top end 70 and a lower end 72 and the suction cup 52 flares outwardly between the top end 70 and the lower end 72. The top end 70 of the suction cup 52 is coupled to a lower surface 66 of the bottom member 64 of the second anchor 50 and the suction cup 52 is centrally located along the bottom member 64 of the second anchor 50.

The buoyant float 58 has a panel portion 74 that is surrounded by a ring portion 76. An upper surface 78 of the panel portion 74 is attached to the lower surface 66 of the bottom member 64 of the third anchor 56 such that the ring portion 76 surrounds the third anchor 56. Furthermore, the buoyant float 58 is substantially hollow to facilitate buoyancy of the buoyant float 58. Additionally, the ring portion 76 has a diameter that is at least twice the diameter of the canister 12 thereby enhancing stability of the canister 12 along a vertical axis while the canister 12 is floating.

In use, either the first anchor 44 is attached to the canister 12 for stabilizing the canister 12 on the ground or the second anchor 50 is attached to the canister 12 to stabilize the canister 12 on a rigid support surface 54 or the third anchor 56 is attached to the canister 12 to float the canister 12 in a body of water 60. In this way either the beverage container 16 or the wine glass 22 can be placed in the canister 12 for storage while a beverage contained in either the beverage container 16 or the wine glass 22 is being enjoyed. Furthermore, the first anchor 44 or second anchor 50 or third anchor 56 ensures the canister 12 remains upright to inhibit the beverage container 16 or wine glass 22 from tipping. The stem slot 18 and the base slot 24 facilitate the wine glass 22 to be slid laterally into or out of the canister 12 rather than having to be lowered into or lifted out of the canister 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An anchored beverage container assembly for holding a beverage container in a secured manner to inhibit the beverage container from tipping over, said assembly comprising:

a canister having a top end being open wherein said canister is configured to insertably receive a beverage container, said canister being comprised of a thermally insulating material wherein said canister is configured to inhibit thermal communication between the beverage container and ambient air when the beverage container is positioned in said canister, said canister having a stem slot extending through said canister wherein said stem slot is configured to accommodate a stem of a wine glass to facilitate the wine glass to be slid laterally into said canister, said canister having a base slot extending through said canister wherein said base slot is configured to accommodate a base of the wine glass when the wine glass is slid laterally into said canister, said canister having a locking slot extending into said canister;

a first anchor being insertable into said locking slot in said canister thereby affixing said canister to said first anchor, said first anchor having a spike extending downwardly from said first anchor wherein said spike is configured to penetrate a support surface for securing said canister to the support surface thereby inhibiting the beverage container or wine glass from tipping when the beverage container or the wine glass is in said canister;

a second anchor being insertable into said locking slot in said canister thereby affixing said canister to said second anchor, said second anchor having a suction sup extending downwardly from said second anchor wherein said suction cup is configured to be compressed against a support surface to suctionally engage the support surface thereby securing said canister to the support surface thereby inhibiting the beverage container or the wine glass from tipping when the beverage container or the wine glass is in said canister; and a third anchor being insertable into said locking slot in said canister thereby affixing said canister to said third anchor, said third anchor having a buoyant float extending downwardly from said third anchor wherein said buoyant float is configured to float in a body of water thereby floating said canister in the body of water thereby inhibiting the beverage container or the wine glass from tipping when the beverage container or the wine glass is in said canister.

2. The assembly according to claim 1, wherein:

said canister has a bottom wall and an outer wall extending upwardly from said bottom wall;

said canister has a partition being positioned closer to said bottom wall than said top end of said canister;

said partition lies on a plane being oriented parallel to said bottom wall wherein said partition is configured to have the beverage container or the base of the wine glass resting on said partition;

said outer wall curls inwardly adjacent to said top such that an opening defined by said top end has a lesser diameter than a diameter of said outer wall;

said stem slot extends through said outer wall;

said stem slot extends from a top end of said outer wall toward said partition;

said base slot extends through said outer wall;

said base slot intersects a bottom end of said stem slot having said base slot being perpendicularly oriented with said stem slot such that said stem slot and said base slot form a T shape; and said base slot is positioned closer to said partition of said canister and said top end of said outer wall of said canister.

3. The assembly according to claim 2, wherein:

said locking slot has a first section extending through said outer wall of said canister; and said first section is positioned closer to said bottom wall than said partition;

said first section is oriented parallel to said bottom wall.

4. The assembly according to claim 3, wherein:

said locking slot has a second section extending through said outer wall of said canister and said bottom wall of said canister;

said second section extends downwardly from and being perpendicularly oriented with said first section; and said second section extends substantially across said bottom wall of said canister.

5. The assembly according to claim 4, wherein:

each of said first anchor and said second anchor and said third anchor has a top member and a bottom member extending downwardly from and being perpendicularly oriented with said top member such that each of said first anchor and said second anchor and said third anchor has a T shape;

said top member of a respective one of said first anchor or said second anchor or said third anchor is insertable into said first section of said locking slot; and said bottom member of a respective one of said first anchor or said second anchor or said third anchor is insertable into said second section of said locking slot.

6. The assembly according to claim 1, wherein:

said first anchor has a bottom member; and said spike is coupled to and extending downwardly from a lower surface of said bottom member of said first anchor, said spike tapering to a point at a distal end of said spike with respect to said lower surface, said spike being centrally located along said bottom member of said first anchor.

7. The assembly according to claim 1, wherein:

said second anchor has a bottom member, said bottom member having a lower surface; and said suction cup has a top end and a lower end, said suction cup flaring outwardly between said top end and said lower end of said suction cup, said top end of said suction cup being coupled to a lower surface of said bottom member of said second anchor, said section cup being centrally located along said bottom member of said second anchor.

8. The assembly according to claim 1, wherein:

said third anchor has a bottom member, said bottom member having a lower surface; and said buoyant float has panel portion being surrounded by a ring portion, an upper surface of said panel portion being attached to said lower surface of said bottom member of said third anchor such that said ring portion surrounds said third anchor.

9. An anchored beverage container assembly for holding a beverage container in a secured manner to inhibit the beverage container from tipping over, said assembly comprising:

a canister having a top end being open wherein said canister is configured to insertably receive a beverage container, said canister being comprised of a thermally insulating material wherein said canister is configured to inhibit thermal communication between the beverage container and ambient air when the beverage container is positioned in said canister, said canister having a stem slot extending through said canister wherein said stem slot is configured to accommodate a stem of a wine glass to facilitate the wine glass to be slid laterally into said canister, said canister having a base slot extending through said canister wherein said base slot is configured to accommodate a base of the wine glass when the wine glass is slid laterally into said canister, said canister having a locking slot extending into said canister, said canister having a bottom wall and an outer wall extending upwardly from said bottom wall, said canister having a partition being positioned closer to said bottom wall than said top end of said canister, said partition lying on a plane being oriented parallel to said bottom wall wherein said partition is configured to have the beverage container or the base of the wine glass resting on said partition, said outer wall curling inwardly adjacent to said top such that an opening defined by said top end has a lesser diameter than a diameter of said outer wall, said stem slot extending through said outer wall, said stem slot extending from a top end of said outer wall toward said partition, said base slot extending through said outer wall, said base slot intersecting a bottom end of said stem slot having said base slot being perpendicularly oriented with said stem slot such that said stem slot and said base slot form a T shape, said base slot being positioned closer to said partition of said canister and said top end of said outer wall of said canister, said locking slot having a first section extending through said outer wall of said canister, said first section being positioned closer to said bottom wall than said partition, said first section being oriented parallel to said bottom wall, said locking slot having a second section extending through said outer wall of said canister and said bottom wall of said canister, said second section extending downwardly from and being perpendicularly oriented with said first section, said second section extending substantially across said bottom wall of said canister;

a first anchor being insertable into said locking slot in said canister thereby affixing said canister to said first anchor, said first anchor having a spike extending downwardly from said first anchor wherein said spike is configured to penetrate a support surface for securing said canister to the support surface thereby inhibiting the beverage container or wine glass from tipping when the beverage container or the wine glass is in said canister;

a second anchor being insertable into said locking slot in said canister thereby affixing said canister to said second anchor, said second anchor having a suction sup extending downwardly from said second anchor wherein said suction cup is configured to be compressed against a support surface to suctionally engage the support surface thereby securing said canister to the support surface thereby inhibiting the beverage container or the wine glass from tipping when the beverage container or the wine glass is in said canister;

a third anchor being insertable into said locking slot in said canister thereby affixing said canister to said third anchor, said third anchor having a buoyant float extending downwardly from said third anchor wherein said buoyant float is configured to float in a body of water thereby floating said canister in the body of water thereby inhibiting the beverage container or the wine glass from tipping when the beverage container or the wine glass is in said canister;

wherein each of said first anchor and said second anchor and said third anchor has a top member and a bottom member extending downwardly from and being perpendicularly oriented with said top member such that each of said first anchor and said second anchor and said third anchor has a T shape, said top member of a respective one of said first anchor or said second anchor or said third anchor being insertable into said first section of said locking slot, said bottom member of a respective one of said first anchor or said second anchor or said third anchor being insertable into said second section of said locking slot;

wherein said spike is coupled to and extending downwardly from a lower surface of said bottom member of said first anchor, said spike tapering to a point at a distal end of said spike with respect to said lower surface, said spike being centrally located along said bottom member of said first anchor;

wherein said suction cup has a top end and a lower end, said suction cup flaring outwardly between said top end and said lower end of said suction cup, said top end of said suction cup being coupled to a lower surface of said bottom member of said second anchor, said section cup being centrally located along said bottom member of said second anchor, and wherein said buoyant float has a panel portion being surrounded by a ring portion, an upper surface of said panel portion being attached to said lower surface of said bottom member of said third anchor such that said ring portion surrounds said third anchor.

* * * * *